United States Patent [19]

Binglin et al.

[11] Patent Number: 4,614,496

[45] Date of Patent: Sep. 30, 1986

[54] COWPER HAVING NO COMBUSTION SHAFT

[76] Inventors: Chen Binglin, Jijian da lou 414, Gucheng Street; Zhang Bopeng, Jijian da lou 405, Gucheng Street, both of Shijingshan, Beijing (Pekin), China

[21] Appl. No.: 657,026

[22] Filed: Oct. 2, 1984

[30] Foreign Application Priority Data

Oct. 5, 1983 [LU] Luxembourg ..... 85029

[51] Int. Cl.[4] ..... F24H 7/00; F23C 5/32

[52] U.S. Cl. ..... 432/214; 431/173; 432/30

[58] Field of Search ..... 432/30, 214, 216, 219; 431/173, 187, 188

[56] References Cited

U.S. PATENT DOCUMENTS

| | | | |
|---|---|---|---|
| 1,164,854 | 12/1915 | Oesterlen et al. | 431/188 |
| 1,656,542 | 1/1928 | Stoecker et al. | 432/214 |
| 3,173,666 | 3/1965 | Petit | 432/214 |
| 3,473,793 | 10/1969 | Cronert | 432/214 |
| 3,568,932 | 3/1971 | Van Laar et al. | 431/187 |
| 4,294,178 | 10/1981 | Borio et al. | 431/173 |

FOREIGN PATENT DOCUMENTS

| | | | |
|---|---|---|---|
| 413283 | 5/1925 | Fed. Rep. of Germany | 431/173 |

*Primary Examiner*—John J. Camby
*Attorney, Agent, or Firm*—Fishman & Dionne

[57] ABSTRACT

A cowper having no combustion shaft is presented wherein a combustion chamber is topped by a cupola and is positioned above the chequerwork. One or more burners are arranged symmetrically on the cupola wall, each burner being installed at a specific angle relative to the horizontal plane through the cupola. A burner duct is installed in the cupola masonry in front of each burner, the outlet of the duct widening conically at the entry into the cupola and being aligned at a particular angle towards the cupola arch.

29 Claims, 7 Drawing Figures

COWPER HAVING NO COMBUSTION SHAFT

BACKGROUND OF THE INVENTION

This invention relates generally to a cowper of the type having no combustion shaft therein. More particularly, this invention relates to a cowper having a combustion chamber positioned above the chequerwork of the cowper and topped by a cupola wherein one or more burners are arranged along the cupola wall. This invention also relates to a novel burner and novel arrangement of burners for the cowper.

In the prior art, conventional cowpers have been provided with an adjoining or internal combustion shaft wherein combustion of a combustion gas (usually enriched blast furnace gas from a blast furnace cowper) is completed before the gas reaches the cupola chamber of the cowper. However, one important disadvantage of such a conventional cowper structure is that the space required for the combustion shaft is not available for blast heating. Moreover, other substantial disadvantages of such conventional cowpers which result from the deflection of hot combustion gases in the cupola of the cowper are well known.

In an effort to eliminate these disadvantages, and to increase the efficiency of the cowper, the space usually provided for an internal combustion shaft has instead been filled with chequer-bricks. Suggestions are also known for cowpers which have no combustion shaft and which are heated from above. However, despite the advantages of these known cowpers without combustion shafts, it will be appreciated by those skilled in the art that it has been impossible to use such cowpers as a practical matter because of the substantial technical and engineering problems which have arisen.

For example, in cowpers with no combustion shaft, only a very short distance is generally available for the burners arranged in the cupola chamber to complete combustion of the gases. Therefore, there is always an ever present danger that the prior art burners will provide incomplete or delayed mixing and combustion upon entry of the gases into the chequerwork. This results in a nonuniform distribution of temperature, along with localized overheating of the chequerwork, which in turn, produces heat damage to the chequerwork and a reduction in efficiency of the cowper process.

Other cowper burners are known in the art wherein the burner or burners are arranged at the edge of a cupola and are pointed upwardly in a vertical direction. As a result, a relatively longer distance is available for the flame to develop than in the case of the burner arrangement described above. However, this latter burner arrangement nevertheless has the disadvantage that, as a result of a possible suction or vacuum from the emerging jets of flames, the combustion gases are deflected by the cupola in a direction counter to the flame jet. As a consequence, there is a greater tendency of the flame to impact upon only selected areas of the chequerwork. This results in nonuniform distribution of the gas over the cross section of the chequerwork wherein the heating surface is poorly utilized and heat stresses arise which may lead to damage or destruction of the chequerwork. The prior art burner arrangement wherein the burners point upwardly has the further disadvantage that the cupola masonry is exposed to disproportionately high thermal stresses.

It is also well known in the prior art for burner arrangements in cowpers of the type having no combustion shafts wherein a plurality of burners are arranged outside the cowper cupola and are connected to the cowper cupola by combustion ducts pointing slightly (tangentially) upwardly. These prior art burner arrangements are such that complete combustion takes place in the combustion duct, and the flue gases entering the cupola are dispersed by the cupola into the chequerwork in a well known conventional manner.

While the above discussed burner arrangements suggest promising solutions to the problems of cowpers without combustion shaft, serious disadvantages have been found during actual use.

For example, while the above-discussed proposed arrangement for the introduction of gases into the cupola chamber does result in better flow thereof along the chequerwork than in the past, this arrangement does not permit uniform distribution of the gas flow over the chequerwork cross-section. It is well known that such uniform distribution is an essential feature for a cowper having no combustion shaft if it is to be successful in practical industrial use. Unfortunately, the above-described cowper structure does not achieve optimum control of the gas flow in the cowper cupola because the inlet speeds of the flue gases are necessarily too high. It is also probable that the above-discussed proposed cowper will not provide the high temperatures and pressures necessary for efficient operation of modern cowpers.

It is believed that the reason that cowpers having no combustion shaft, particularly cowpers for blast furnace heating, have not yet found partical acceptance in industry may be attributed to the disadvantages and difficulties discussed above.

SUMMARY OF THE INVENTION

The above discussed and other problems and deficiencies of the prior art are overcome or alleviated by the cowper having no combustion shaft of the present invention. In accordance with the present invention, a cowper having no combustion shaft and having a combustion chamber positioned above the chequerwork is connected to a cupola, the cupola having one or more burners arranged along the wall thereof. Each of the burners has a specific orientation. A burner duct is installed in the cupola masonry in front of each burner, the outlet of the duct widening conically at the entry into the cupola and being aligned at a particular angle towards the cupola arch. The cupola chamber above the chequerwork is primarily used for the complete combustion of the combustion gases. The present invention solves many of the problems discussed above despite the prevalent view among those skilled in the art that combustion should be kept as far as possible from the cowper cupola. The present invention provides controlled uniform distribution of gas flow through the chequerwork of a cowper having no combustion shaft.

The above discussed and other advantages of the present invention will be apparent to and understood by those skilled in the art from the following detailed description and drawings.

DESCRIPTION OF THE PREFERRED EMBODIMENT

Figure 1:
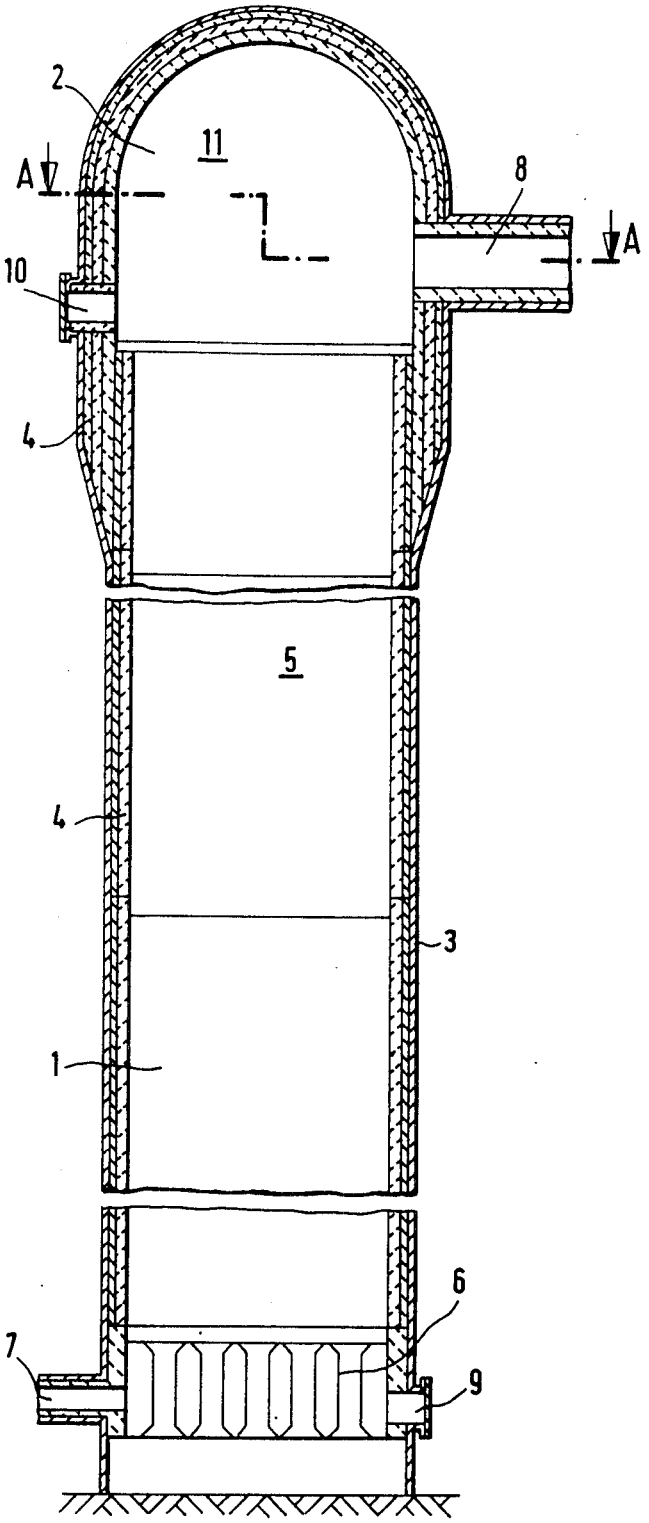
FIG. 1 is a cross sectional elevation view through a cowper having no combustion shaft in accordance with the present invention.

Referring first to FIG. 1, a cowper of the type having no combustion shaft is shown which consists of a vertical chequerwork shaft 1 and a cupola 2 offset from the chequerwork shaft so as to allow for expansion, both of which are enclosed by a gas-tight iron shell 3. Iron shell 3 is protected in a conventional manner by refractory masonry and insulating materials 4. Shaft 1 is equipped with a chequerwork or filling 5 of refractory bricks for storing or releasing heat. The refractory chequerwork 5 rests on a grid iron 6 supported by support columns. At the lower end of the cowper (i.e, at the level of the grid iron 6), a connecting pipe 7 is provided for entering cold air to be heated and also for flue gases to be extracted during heating of the chequerwork 5. The cupola 2 which is located above and adjoining the cowper is placed on the upper end of the shaft masonry 5 in a conventional manner, so that shaft 1 and the internal masonry can expand into the cupola masonry. The cupola arch is provided with a connecting pipe 8 which serves to extract heated air passed through the cowper. At least one manhole, 9 and 10 respectively, is provided at the lower end of the cowper (i.e., on the level of the grid iron), and also in the cupola wall somewhat above the filling 5.

Figure 3:
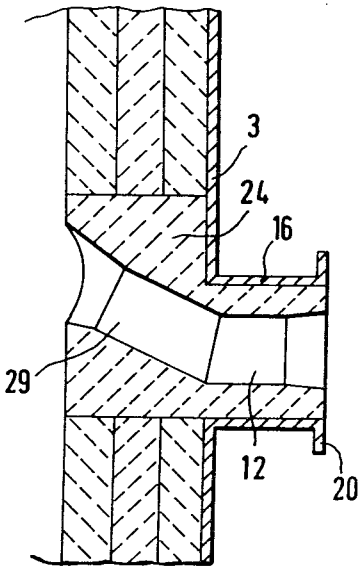
FIG. 3 is a cross sectional elevation view along the line B—B of FIG. 2.
Figure 2:
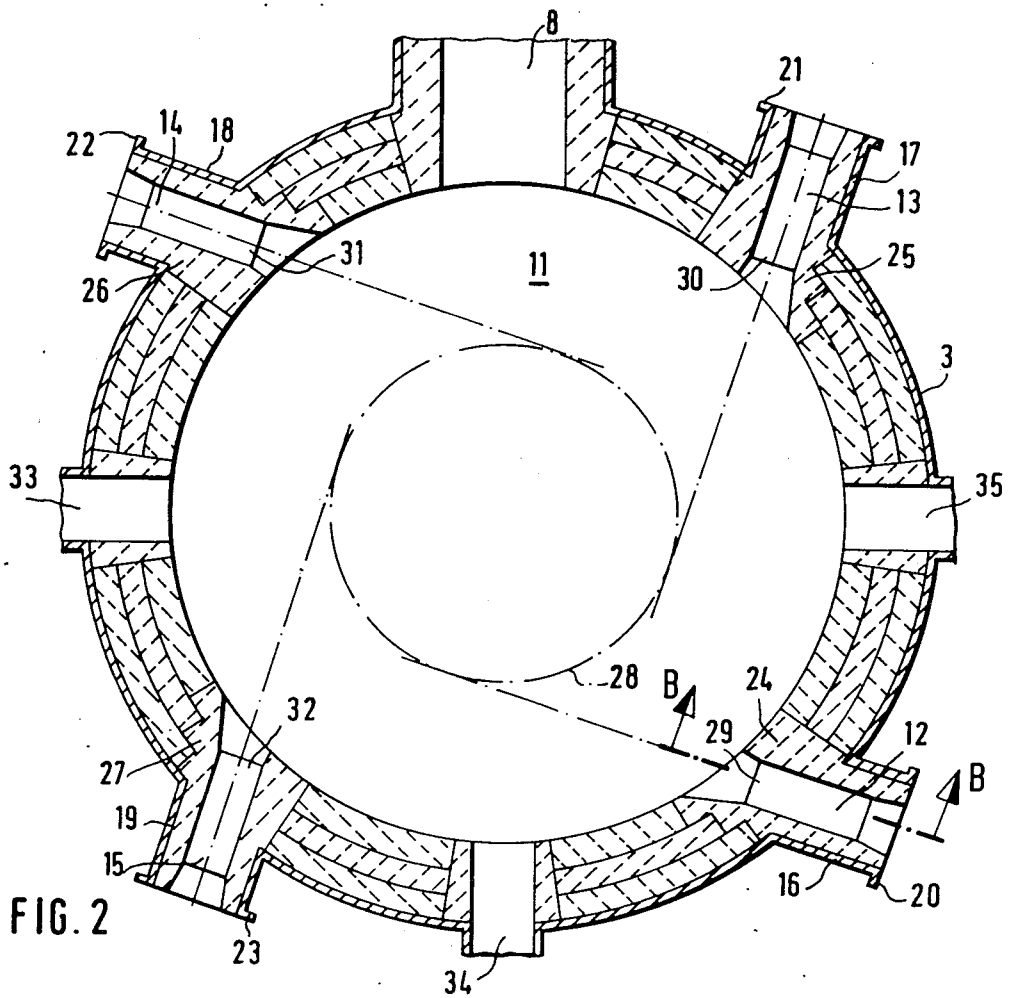
FIG. 2 is a cross sectional elevation view along the line A—A of FIG. 1.

In accordance with the present invention, cowper 1 differs from conventional cowpers currently in operation in that the cupola arch is designed as a combustion space or combustion chamber 11, wherein one, but preferably more, burner ducts or mixing ducts 12, 13, 14 and 15 are symmetrically arranged on and terminate at the periphery of the cupola, as is best shown in FIGS. 2 and 3. Burner ducts 12, 13, 14 and 15 are connected via metal pipes 16, 17, 18 and 19 to the iron shell 3 of the cowper cupola 2 and are each provided with a connecting flange 20, 21, 22 and 23 for the burner. Each burner duct 12, 13, 14 and 15 has an inner lining 24, 25, 26 and 27 of refractory material, which has the same thickness as and is used in place of the cupola lining. As shown in FIG. 2, burner ducts 12, 13, 14 and 15 are arranged symmetrically along the cupola wall (periphery) while also penetrating the cupola periphery at a selected angle. As a result, the position of the ducts in the horizontal plane is slightly inclined relative to the position tangential to the cupola periphery. In the particular embodiment shown in FIG. 2, the position of the four burner ducts 12, 13, 14 and 15 has been selected so that there is an internal cupola diameter of approximately 6620 mm, the mid-lines of the four burner ducts defining the tangents of a central circle 28 having a diameter of approximately 3400 mm. It will be appreciated further that details of the shape of the individual burner ducts, and of the combustion circulation, will be given below in connection with the description of the burners.

Although the above discussed burner ducts 12, 13, 14 and 15, are arranged symmetrically along the cupola periphery, this symmetrical arrangement has not been selected so as to be opposite from the hot-blast extraction pipe 8, but, as becomes clear from FIG. 2, the burner duct arrangement has been slightly offset relative to the extraction pipe 8.

FIG. 3 is a cross-section of burner duct 12 along the line B—B of FIG. 2. It will be appreciated from FIG. 3 that not only does duct 12 have a slight tangential inclination in the horizontal plane relative to the cupola periphery, but also, in a similar manner, the duct outlet or opening 29 to the cupola is oriented upwardly at a certain angle towards the cupola arch. A similar angle of orientation is also found in duct openings 30, 31 and 32.

Preferably, duct opening 29 has a conical shape which diverges toward the interior of the cupola. In the particular embodiment shown in FIG. 3, a preferred conical angle of about 26° has been selected.

In accordance with another embodiment (not shown in FIG. 3), it may be advantageous to construct each duct opening 29, 30, 31 and 32 as a rotatable (rather than fixed) insert in the cowper wall 3, in order to permit hot gas distribution within the cupola (combustion circulation) to be modified or changed at any time by adjusting the entry into the cupola of the individual duct openings 29, 30, 31 and 32.

Referring again to FIG. 2, three manholes 33, 34 and 35 are shown symmetrically arranged about the cowper periphery (relative to the gas extraction pipes).

Figure 4:
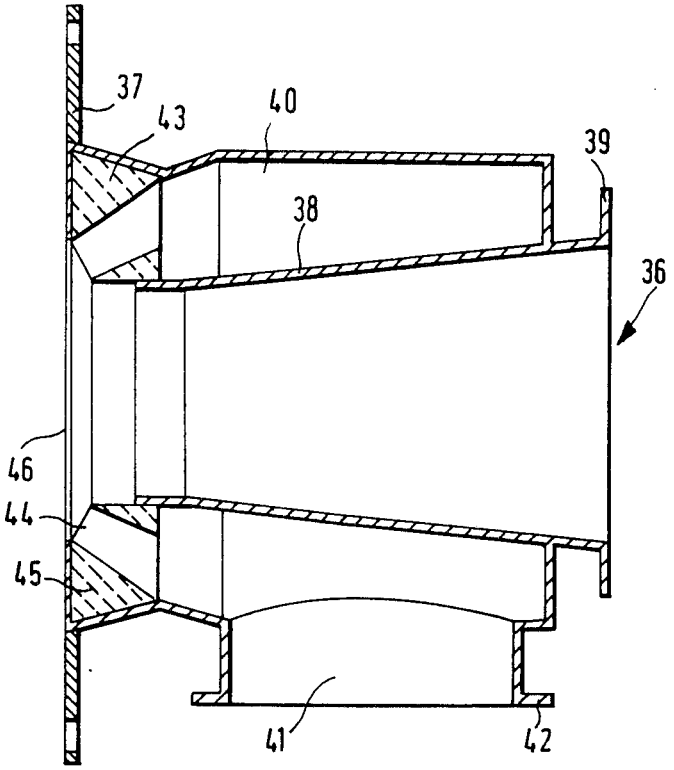
FIG. 4 is a cross sectional elevation view through a burner used in conjunction with the cowper of FIG. 1.

In FIG. 4, a burner 36 is connected via a flange 37 to each of the flanges 20, 21, 22 and 23, respectively, of each burner duct 12, 13, 14 and 15. Burner 36 consists of a gas inflow cone 38 having a flange 39 for connection to a gas feedline, an annular space 40 for the combustion air surrounding the gas inflow cone 38, a connecting pipe 41 and associated flange 42 for the combustion air feed, a combustion air distributor 43 and a burner flange 37 on the burner duct or mixer duct. The various burner components are preferably comprised of welded sheet steel. In the burner embodiment shown in FIG. 4, the combustion air distributor 43 is formed from a number of individual nozzles 44, which are incorporated in a ring 45 of refractory material and are surrounded by a perforated plate 46 shown in FIG. 5. A mixing chamber 47 (see FIG. 6) is provided adjacent to the perforated plate 46, and leads into the mixing duct 12, 13, 14 and 15 respectively. Preferably, the nozzles 44 are arranged such that the longitudinal axes thereof converge in the mixing chamber 47.

Burner 36 includes a burner tip which is rigidly connected thereto. It should be understood that the burner tip may alternatively be designed to be interchangeable, so that, for example, the nozzle 44 of the combustion air distributor 43 can be oriented to the gas flow at an angle different from that shown in FIG. 4.

In accordance with the present invention, listed below are various design factors which have been found important in constructing the cowper having no combustion shaft shown in FIGS. 4 and 5.

Depending upon the applicable safety standards and on the gas and air pressures, it will always be necessary to keep the gas velocity and air velocity in any partial section of the feed lines at the most desirable flow rate. The flow rate of the gas/air mixture at the burner outlet should be above the ignition rate, even in the case of minimum throughputs, in order to (1) avoid flashback and (2) permit only insignificant combustion in the mixing ducts 12, 13, 14 or 15. The angle of conicity of the gas in flow cone 38 which diminishes in the direction of the gas flow, is preferably designed so that the outlet rate of the gas $W_2$ is at least 1.5 $W_1$ (where $W_1$ is the inlet velocity). A specific ratio between the outlet velocity $W_4$ of the air from the nozzles 44 and the inlet velocity of the gas $W_2$ must be retained. In the embodiment shown, $W_4$ is approximately $2W_2$. This design has shown that, given the usual gas compositions (in this case blast furnace gas with or without addition of rich gas), the burner will operate correctly and without flashbacks, even at as little as 50% of its nominal output and with changed gas thermal values.

Figure 5:
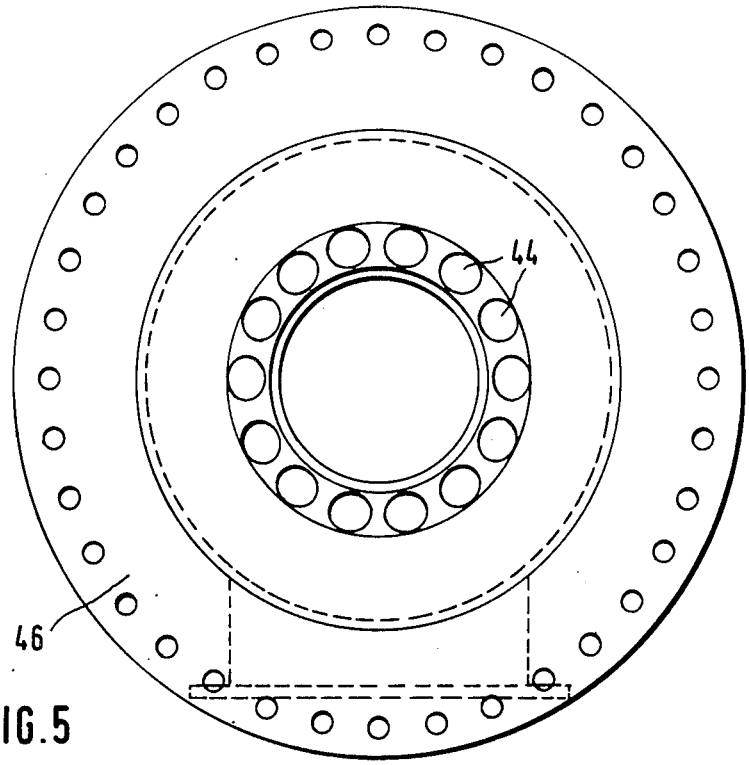
FIG. 5 is a plan view of a perforated plate of a combustion air distributor used in the burner of FIG. 4.

In burner 36 of FIGS. 4 and 5 (which is constructed in accordance with Terbeck's principal), combustion air impinges on the gas flow at a certain angle (at an angle of 30° in the particular embodiment shown), and, since at the same time the air velocity is higher than the gas velocity, the mixing operation is substantially assisted and backdrift is virtually eliminated. As a result, burner 36 provides complete mixing within each of the ducts 12, 13, 14 or 15. Moreover, in the case of the embodiment constructed within the design parameters set forth hereinabove, complete combustion takes place with an excess of air of as little as 1.025.

Burner 36 and the arrangement thereof on the cupola as described, produces a configuration which permits combustion with a short flame in the combustion chamber, so that the combustion of the air/gas mixture is completed before the exhaust or flue gases enter the cowper filling 5.

In a preferred embodiment, (FIG. 2) plural burners 36 are arranged symmetrically about cowper cupola in accordance with the principle explained above. It has been found that, in the case of a cowper cupola having a cupola diameter in excess of 6,000 meters, preferred results are achieved by means of a symmetrical arrangement of four burners, whose horizontal angle of irradiation has been selected such that uniform distribution over the cupola cross-section results.

The burner shown in FIG. 4 is, as already described, composed of sheet steel components, apart from the ring 45 for injecting the combustion air, which has usually been preheated. It has been found that this sheet steel design can be used despite high temperatures of the cupola interior, as the burner 36 is well protected from the thermal radiation of the cupola by the downwardly inclined shape of the burner ducts 12, 13, 14 and 15.

Figure 7:
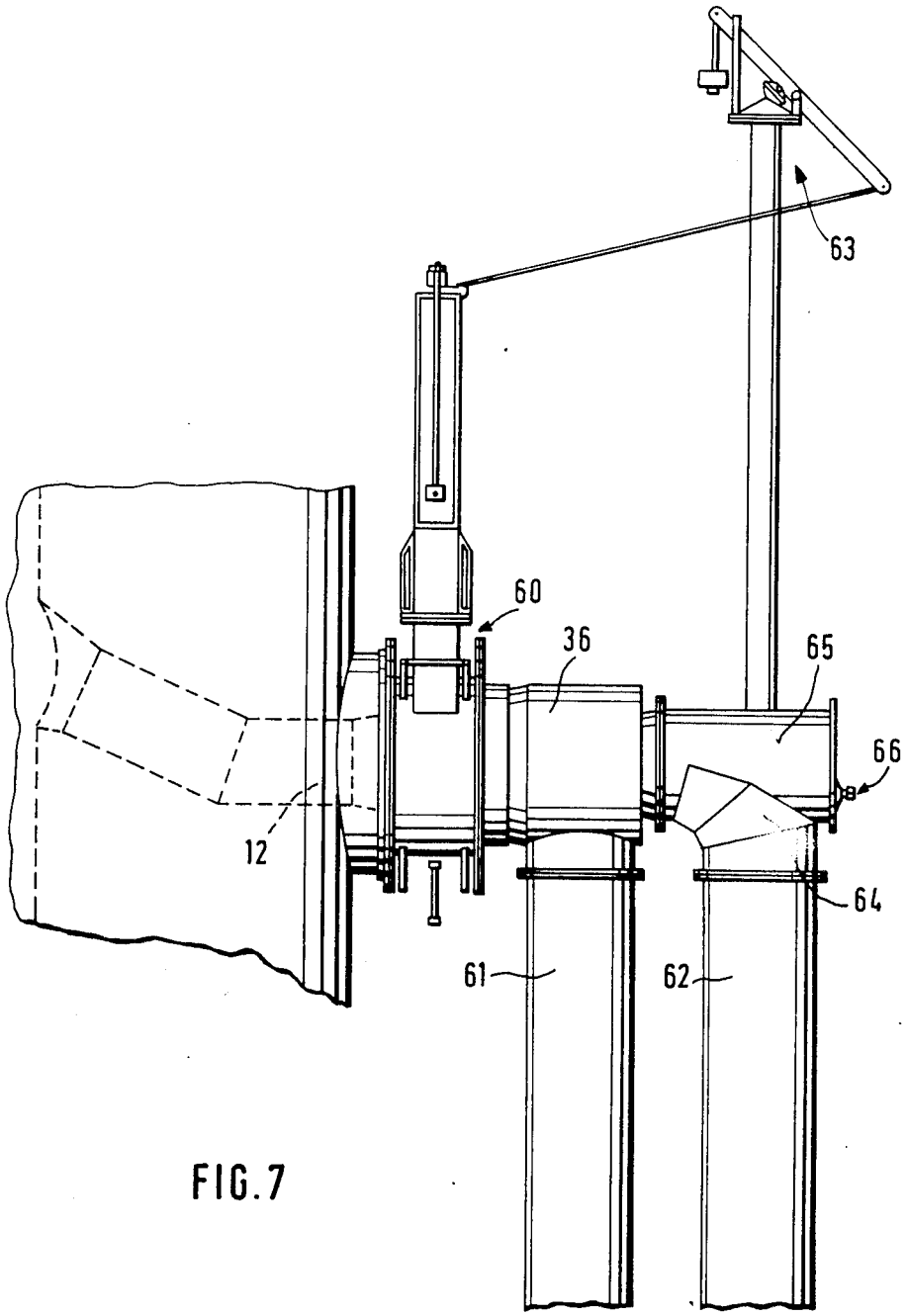
FIG. 7 is an elevation view of a burner shut-off valve and safety apparatus used in conjunction with the present invention.

Referring now to FIG. 7, a water-cooled or otherwise cooled slide valve 60 which is closed at the time of blasting to shield burner 36 against damage by the hot blast or by back-reflection of heat, is located between burner 36 and the combustion or mixing ducts 12, 13, 14 or 15. It will be appreciated that during the gassing period, burner 36 is cooled by the media flowing through it, i.e., gas and combustion air.

Alternatively, instead of the costly slide valve 60, the service life of the burner 36 may be prolonged by means of a thermal shield, which is provided in front of the perforated plate 46 in the form of a push-in slide during the blasting period.

Figure 6:
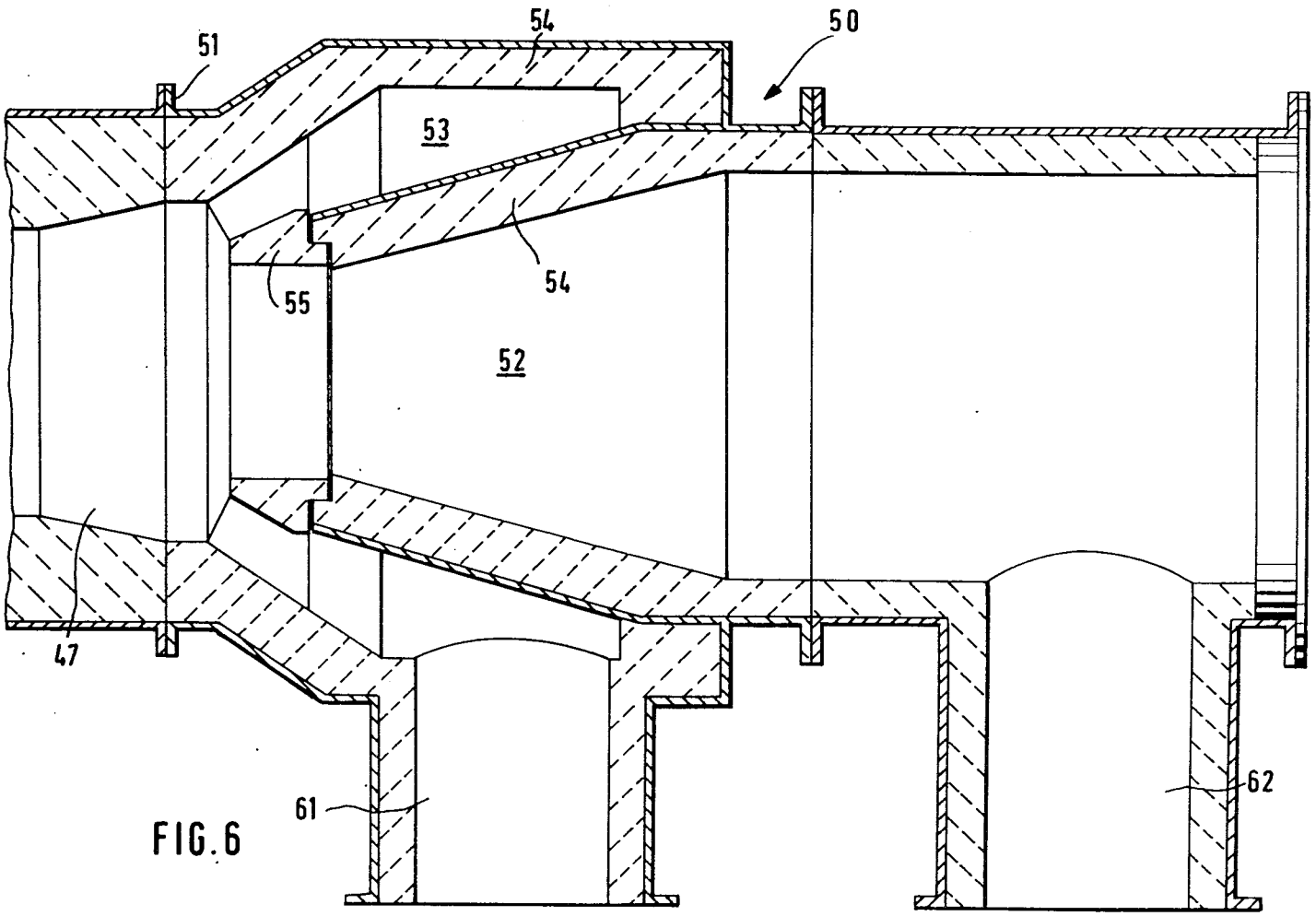
FIG. 6 is a cross sectional elevation view through another embodiment of a burner used in conjunction with the cowper of FIG. 1.

In FIG. 6, another embodiment of a burner 50 is shown, wherein the individual burner components are lined with refractory material. Burner 50 is connected to one of the burner ducts or mixing ducts 12, 13, 14 and 15 via the flange 51. Both the gas inflow cone 52 and the combustion air ring 53 surrounding it are provided with a refractory masonry lining. The combustion air distributor 55 is similarly made from refractory material and, as shown in FIG. 6, the shape of the gas inflow cone 52 and that of the combustion air ring 53 with associated combustion air distributor 55 has been selected so that the lined burner components can be easily assembled simply by sliding them into one another. It will be appreciated that in other respects, burner 50 in FIG. 6 is similar to burner 36 in FIG. 4 and is constructed in the same manner as discussed above in connection with burner 36.

In the embodiments of burners shown in FIGS. 4 and 6, combustion air is directed toward the centrally inflowing gas via nozzles at increased velocity. It is, however, also possible to introduce the gas into the annular space and to let it impinge at increased velocity on a central air flow. In this case, both the gas velocity and the air velocity must be altered to accordingly, and the design of the burner must be adapted in order to achieve the desired mixing ratios in the burner ducts 12, 13, 14 or 15, as described above.

Under certain circumstances, the effect of the impingement of the combustion air flow on the gas flow can be increased by imparting a spinning motion to the air flow to achieve more rapid and complete mixing in the edge zone.

As previously mentioned, a water-cooled shut-off slide valve 60 of conventional design is usually provided between the mixing ducts 12, 13, 14 or 15 and the burner 36 or 50 (see FIG. 7). Air is fed to the burner via the line 61, and gas (fuel) is fed to the burner via the line 62. Both lines are preferably branch lines which rise up to the burner from a common ring line provided about the cowper, (in cases where a plurality of cupola burners are provided per cowper). The gas feedline leads, via an elbow 64, into a chamber 65 installed upstream of the burner. The connecting flange of chamber 65 is provided with an inspection torque 66 for observing the combustion process. FIG. 7 also shows a safety device 63 of simple construction connected to the chamber 65 (and mechanically linked to the drive of the shut-off slide valve) for venting the gas feedlines 62 after closure of the cut-off slide valve 60.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A cowper having no combustion shaft therein comprising a vertical chequerwork shaft and including:

combustion chamber means disposed above the chequerwork and adapted for the combustion of fuel and air at a preselected combustion rate;

a cupola having an outer cupola wall surrounding a cupola interior, said cupola interior defining said combustion chamber means, a portion of said cupola having a circular cross-section in the horizontal plane through said cupola wall, said cupola being topped by a cupola arch; and at least one burner means being positioned along the wall of said cupola, said burner means having fuel and air flowing therethrough at respective preselected flow rates, said burner means leading to a burner duct adapted for mixing the fuel and air flowing therethrough prior to combustion in said cupola interior, said burner duct being located in said cupola wall and being inclined relative to said horizontal plane, said burner duct having a conically shaped outlet section which diverges towards said cupola interior, said duct outlet section being oriented upwardly at a selected angle toward said cupola arch whereby the respective flow rates of the fuel and air at the burner duct outlet section are above the preselected combustion rate of the fuel and air in said combustion chamber means.

2. The cowper of claim 1 including:

a plurality of burner means being positioned along the cupola wall.

3. The cowper of claim 2 wherein:

said plurality of burner means are symmetrically arranged along the cupola wall.

4. The cowper of claim 1 wherein said burner means further includes:

means for delivering combustion air; and means for delivering gaseous fuel.

5. The cowper of claim 4 wherein:

said fuel gas delivering means comprises a central gas inflow cone; and said combustion air delivery means comprises an annular air distributor means.

6. The cowper of claim 5 wherein said combustion air distributor means comprises:

a plurality of nozzles, said nozzles being annularly arranged about said fuel gas inflow cone.

7. The cowper of claim 4 wherein:

said combustion air delivering means comprises a central air inflow cone; and said fuel gas delivery means comprises an annular gas distributor means.

8. The cowper of claim 7 wherein said fuel gas distributor means comprises:

a plurality of nozzles, said nozzles being annularly arranged about said combustion air inflow cone.

9. The cowper of claim 6 wherein said nozzles are at least partially incorporated in refractory material.

10. The cowper of claim 8 wherein said nozzles are at least partially incorporated in refractory material.

11. The cowper of claim 6 including:

a mixing chamber provided between said burner means and said burner duct.

12. The cowper of claim 8 including:

a mixing chamber provided between said burner means and said burner duct.

13. The cowper of claim 11 including:

perforated plate means between said mixing chamber and said burner means, said nozzles being surrounded by said perforated plate means.

14. The cowper of claim 12 including:

perforated plate means between said mixing chamber and said burner means, said nozzles being surrounded by said perforated plate means.

15. The cowper of claim 11 wherein:

said plural nozzles are arranged such that the longitudinal axes of said nozzles coverge in said mixing chamber.

16. The cowper of claim 12 wherein:

said plural nozzles are arranged such that the longitudinal axes of said nozzles coverge in said mixing chamber.

17. A cowper having no combustion shaft therein comprising a vertical chequerwork shaft and including:

combustion chamber means disposed above the chequerwork and adapted for the combustion of fuel and air;

a cupola having an outer cupola wall surrounding a cupola interior, said cupola interior defining said combustion chamber means, a portion of said cupola having a circular cross-section in the horizontal plane through said cupola wall, said cupola being topped by a cupola arch;

at least one burner means being positioned along the wall of said cupola, said burner means leading to a burner duct adapted for mixing the fuel and air prior to combustion in said cupola interior, said burner duct being located in said cupola wall and being inclined relative to said horizontal plane, said burner duct having a conically shaped outlet section which diverges towards said cupola interior, said cuct outlet section being oriented upwardly at a selected angle toward said cupola arch; and slide valve means positioned between said burner means and said burner duct.

18. The cowper of claim 17 including:

cooling means for cooling said slide valve means.

19. The cowper of claim 18 wherein said cooling means includes a liquid or gaseous cooling medium.

20. The cowper of claim 6 including:

means for regulating the ratio of the outlet velocity of the combustion air from the nozzles to the outlet velocity of the fuel gas from the inflow cone to be greater than 1, said fuel gas outlet velocity being greater than said air outlet velocity.

21. The cowper of claim 1 wherein:

at least a portion of said burner means is lined with refractory material.

22. The cowper of claim 1 wherein:

said duct outlet section is fixedly positioned at said selected angle.

23. The cowper of claim 1 wherein:

said duct outlet section is rotatably positioned at said selected angle.

24. A cowper having no coumbustion shaft therein comprising a vertical chequerwork shaft and including:

combustion chamber means disposed above the chequerwork and adapted for the combustion of fuel and air;

a cupola having an outer cupola wall surrounding a cupola interior, said cupola interior defining said combustion chamber means, a portion of said cupola having a circular cross-section in the horizontal plane through said cupola wall, said cupola being topped by a cupola arch;

at least one burner means being positioned along the wall of said cupola, said burner means leading to a burner duct adapted for mixing the fuel and air prior to combustion in said cupola interior, said burner duct being located in said cupola wall and being inclined relative to said horizontal plane, said burner duct having a conically shaped outlet section which diverges towards said cupola interior, said duct outlet section being oriented upwardly at a selected angle toward said cupola arch; and means for shielding said burner means from combustion heat generated in said combustion chamber means.

25. The cowper of claim 24 wherein:

said shielding means is positioned between said burner means and said burner duct.

26. The cowper of claim 24 wherein:

said shielding means comprises valve means.

27. The cowper of claim 25 wherein:

said shielding means comprises valve means.

28. The cowper means of claim 26 wherein:

said valve means comprises slide valve means.

29. The cowper means of claim 27 wherein:

said valve means comprises slide valve means.

* * * * *